US006957897B1

(12) United States Patent
Nelson et al.

(10) Patent No.: US 6,957,897 B1
(45) Date of Patent: Oct. 25, 2005

(54) FLASHLIGHT WITH LIGHT EMITTING DIODE SOURCE

(75) Inventors: Wordell Nelson, South Euclid, OH (US); Hesham M Elghoroury, Solon, OH (US); Edward J. Thomas, Streetsboro, OH (US)

(73) Assignee: General Electric Company, Schenectady, NY (US)

( * ) Notice: Subject to any disclaimer, the term of this patent is extended or adjusted under 35 U.S.C. 154(b) by 761 days.

(21) Appl. No.: 09/604,474

(22) Filed: Jun. 27, 2000

(51) Int. Cl.[7] ..... F21L 4/00

(52) U.S. Cl. ..... 362/184; 362/154; 362/185; 362/205; 362/295; 362/187

(58) Field of Search ..... 362/154, 185, 362/205, 295, 251, 800, 187, 184

(56) References Cited

U.S. PATENT DOCUMENTS 3,160,722 A * 12/1964 Sellers ..... 362/202
4,228,485 A 10/1980 Hubbard et al.
4,290,095 A 9/1981 Schmidt
4,346,329 A 8/1982 Schmidt
6,004,008 A * 12/1999 Lai ..... 362/280
6,024,471 A * 2/2000 McDermott ..... 362/394
6,086,218 A * 7/2000 Robertson ..... 362/157
6,095,661 A * 8/2000 Lebens et al. ..... 362/184
6,168,288 B1 * 1/2001 St. Claire ..... 362/184
6,193,388 B1 * 2/2001 Halasz et al. ..... 362/205
6,213,623 B1 * 4/2001 Campman ..... 362/202
6,250,771 B1 * 6/2001 Sharrah et al. ..... 362/184

* cited by examiner

*Primary Examiner*—Stephen Husar
*Assistant Examiner*—Anabel Ton
(74) *Attorney, Agent, or Firm*—Fay, Sharpe, Fagan, Minnich & McKee, LLP

(57) ABSTRACT

An apparatus for improving the performance of flashlights includes a substantially cylindrical housing (10) having a first end (12) and a second end (14). A battery cap (18) is operatively connected to the first end of the housing and functions to secure a series of batteries in place. A series (30) of light emitting diodes (LED) (32–48) are mounted within the flashlight housing at the end opposite the battery cap. The series of LEDs form an LED array which operates as the light source for the flashlight. A substantially cone-shaped optical assembly (50) extends outward from the second end of the housing and operates to focus and disperse the LED beam emitted by the LED array. The flashlight further includes an adjustable switch (56) disposed on the exterior of the housing. The switch is coupled to a variable resistor (58) which permits control over the light level and/or battery life. An electronic current regulator (70), enclosed by the housing, allows the LED beam to remain at a constant and desired light level, thereby increasing the efficiency of the battery life. A dynamic pulse control system (74) is coupled to the switch which takes advantage of the human eye perceiving the pulsed beam to be continuous. The pulse control also increases the peak current through the LED source.

9 Claims, 2 Drawing Sheets

FLASHLIGHT WITH LIGHT EMITTING DIODE SOURCE

BACKGROUND OF THE INVENTION

1. Field of the Invention

This invention pertains to an apparatus for improving the performance of flashlights by providing a longer lighting life and higher efficacy. More particularly, the invention relates to improving flashlight performance by replacing a standard incandescent miniature lamp found in conventional flashlights with a light emitting diode (LED).

2. Discussion of the Art

Conventional flashlights use miniature incandescent lamps as a light source. Incandescent lamps generally require filaments and cathode tubes for operation. Filament lamps and cathode tubes, although widely used and commercially successful, are relatively fragile and require careful handling. Components of these lamps often break, even when receiving only a small shock. In addition, filament lamps have a relatively short operating life, thereby giving users the trouble of frequently replacing a burned out bulb and tube shaped portions. Furthermore, filament lamps are not the most economical. These lamps have numerous components making them relatively expensive to manufacture. Finally, filament lamps have a relatively high power consumption. These characteristics have led researchers to study new ways to provide more efficient lighting.

Light emitting diodes (LEDs) have made significant advances in providing a light source having increased performance since their inception in the 1960's. In the 1980's, red-emitting AlGaAs LEDs were developed, such devices being more energy efficient and longer lasting producers of red light than red-filtered light sources in various applications, such as automotive brake lights. Moreover high-efficiency LEDs have been developed and are commercially available in the blue and blue/green wavelength range based on, for example, InGaN and AlGaN semiconductor materials.

The advent of UV and blue LEDs allowed the possibility to generate white light from an LED by applying luminescent phosphor materials on top of the LED. This layer of phosphor partially transforms the UV or blue light into longer wavelengths, e.g. yellow light. Successful implementation of such a device is dependent upon the efficient conversion of UV/blue light into visible light of the desired wavelength and the subsequent efficient extraction of the generated visible light from the device. However, the first commercially available white light LED systems were not competitive with standard light sources with respect to performance, since the phosphor layer only partially transformed the UV or blue light into longer wavelengths. Not until recently have devices and methods been developed for efficiently converting UV/blue light into visible light.

White-light LED systems provide significant benefits over traditional incandescent lamps. As white light producing LED systems become more refined and efficient, a need exists to expand the use of such systems into others areas, such as the art of flashlights. As already discussed, current incandescent lamps used for flashlights have multiple components (increasing the cost to manufacture), are fragile, and have a relatively short operating life. Constructing a flashlight with an LED as its light source would alleviate most, if not all, of the foregoing problems. To date, no device exists which adequately utilizes an LED system in flashlights. Therefore, it would be advantageous to provide an LED light source for flashlights which replaces the traditional filament lamp with an LED light source.

BRIEF SUMMARY OF THE INVENTION

A new and improved apparatus is provided for improving the performance of a flashlight system by replacing miniature incandescent lamps found in conventional flashlights with a light emitting diode.

An improved flashlight assembly includes a housing. At least one light emitting diode (LED) mounted within the housing. The LED generates an LED beam and serves as the light source. An optical lens extends from an end of the housing for focusing and dispersing the light from the LED source to a desired light contour.

One advantage of the present invention is the provision of a flashlight having longer life and increased reliability.

Another advantage of the present invention resides in a flashlight having a minimal number of components.

Another advantage of the present invention is provided by eliminating the need for a filament for flashlights, thereby eliminating the potential for filament failure.

Another advantage of the present invention is the ability to more precisely control the light emitted from the flashlight.

Another advantage of the present invention is the provision of a flashlight having a minimal cost of operation due to the inherently low power consumption of the device.

Yet another advantage of the present invention is the provision of a flashlight capable of operating at relatively cool temperatures.

Yet another advantage of the present invention is the provision of a switch in the form of a variable resistor, allowing control of the intensity of optical output and the number of LEDs in operation.

Still another advantage of the present invention is the provision of a flashlight having constant current control which allows for full utilization of battery capacity.

Still another advantage of the present invention is the provision of a flashlight having a dynamic pulse control circuit for taking advantage of the persistence of the human eye and increasing the peak current through the LED source.

Still other benefits and advantages of the invention will become apparent to those skilled in the art upon a reading and understanding of the following detailed specification.

DETAILED DESCRIPTION OF THE INVENTION

Figure 1:
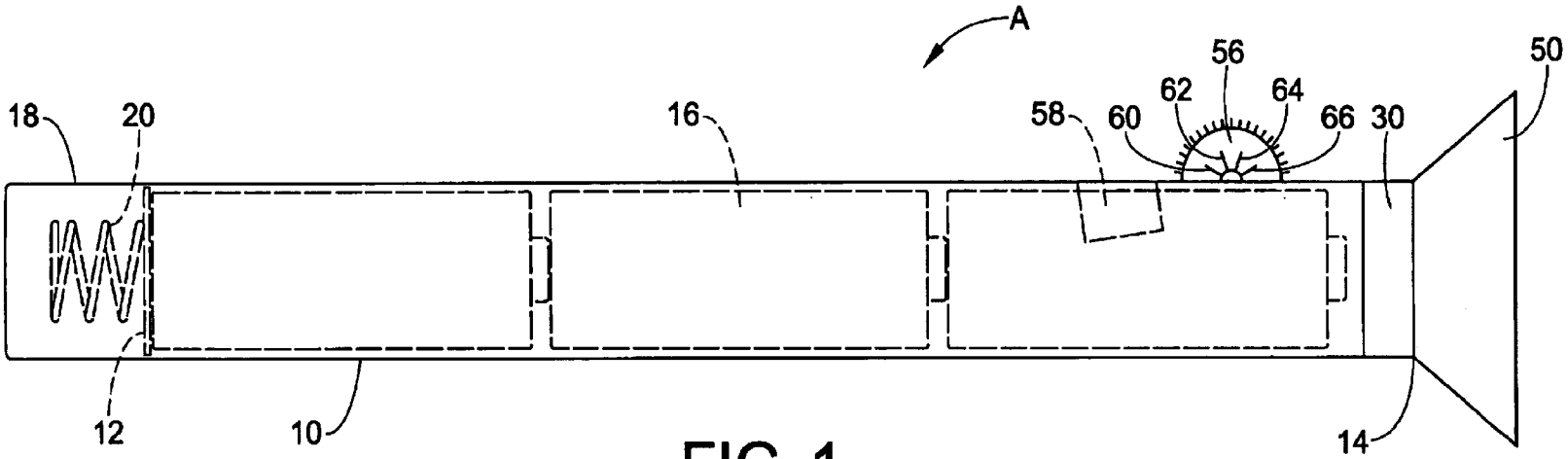
FIG. 1 is an elevational view of a flashlight in accordance with the present invention.

FIG. 1 shows an exemplary embodiment of a flashlight A in accordance with the present invention. The flashlight includes a housing 10 having a first end 12 and a second end 14. Although the housing is preferably a polymeric material and is shown as being substantially cylindrical, other materials or configurations (such as a pistol grip conformation) may be used without departing from the scope and intent of the present invention. A series of batteries 16 are enclosed within the housing and are disposed along a longitudinal axis of the housing. The batteries function as the power source for the flashlight and may be of any desired size and type, including but not limited to alkaline, nickel cadmium, standard, heavy duty, lithium, nickel metal hydride, and others. The power source can be a capacitor or other energy storage means due to the inherent high efficiency of the device.

A battery cap 18 defines a first end 12 of the housing and functions to secure the batteries in place. In the exemplary embodiment, the battery cap is fastened onto a threaded surface located at the first end of the housing, although alternative arrangements can be used with equal success. A battery spring 20 is mounted within the battery cap and extends axially outward from the battery cap g thereby urging the batteries toward the second end 14 of the housing. At the opposite end of the housing is a light transparent lens 22 operatively located to direct light from the light source outwardly from the housing. As is known, the lens may be instrumental in directing the light from the flashlight, as well as providing protection from the external environment.

With continued reference to FIG. 1, an array of LEDs 30, mounted within the flashlight housing 10 at the end opposite the battery cap, operates as the light source for the flashlight. The array of LED's replaces the standard incandescent lamp and associated hardware that are used in conventional flashlights. The incorporation of LEDs as the light source offers simple maintenance and increased reliability.

Figure 2:
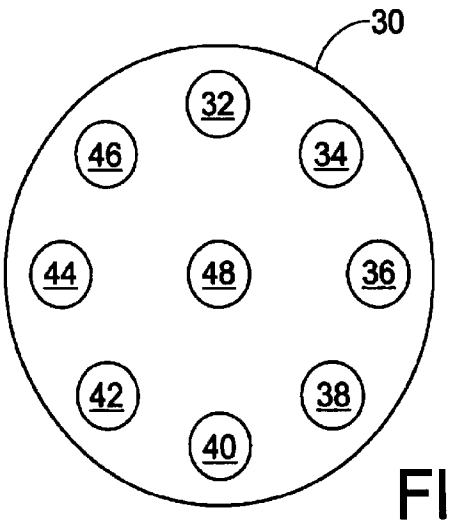
FIG. 2 is an enlarged end view of an array of LEDs operating as the light source of the present invention, taken generally from the right-hand side of FIG. 1.

Referring now to FIG. 2, the array of LEDs preferably includes nine individual LEDs 32, 34, 36, 38, 40, 44, 46, 48 disposed within the same general plane. However, any number of LEDs forming any number of arrays is contemplated by the present invention. The individual LED can be of multiple colors of spectral output, thereby giving the desired light output, light level, and beam characteristics. In the illustrated embodiment, eight of the individual LEDs 32, 34, 36, 38, 40, 42, 44, 46 are arranged concentrically around the ninth LED 48, thus forming a substantially circular configuration. Each of the eight LEDs is equally spaced from each other and from the ninth LED.

Returning now to FIG. 1, the flashlight A includes an optical assembly or reflector 50 for focusing and dispersing an LED beam emitted by the LED array. The optical assembly is substantially cone shaped having a diameter which increases as the reflector extends outward from the second end 14 of the housing 10. The reflector is adapted to move or rotate so that the focus of the reflector and the dispersion of the LED beam can be adjusted as desired. Alternatively, focus and dispersion may be adjusted by fixing the optical assembly and allowing the LED array to move or rotate. It will be further appreciated that the reflector, although illustrated as a cone could also adopt a wide variety of alternative conformations, such as a paraboloid, compound paraboloid, etc.

The flashlight A of the present invention further includes an adjustable switch 56 disposed on the exterior of the housing and coupled to a variable resistor 58 which permits control over the light level and/or battery life. The switch 56 is designed as a rheostat so that it is possible to change the resistance value without interrupting the circuit to which it is connected. As such, a user may adjust the optical output to any desired level. Alternatively, or in addition to the rheostat design, the switch may have step level variable control which allows a user to choose from distinct levels of illumination. The switch is preferably a rotatable thumb wheel which adjusts the levels of illumination upon rotation. However, any conventional switch, such as a slidable button, lever, or push button, is within the scope and intent of the present invention.

In addition to the foregoing features, the switch 56 enables a user to selectively turn on and off any number of individual LEDs in the LED array 30. In the illustrated embodiment, the thumb wheel 56 is rotated to four distinct positions 60, 62, 64, 66 corresponding to four different levels of optical output. At the first position 60, only the ninth LED 48 or center LED of the LED array is activated. At the second position 62, only the third 36, sixth 42, and eighth 46 LEDs, for example, are activated. At the third position 64, the second 34, fourth 38, sixth 42, eighth 46, and the ninth 48 LEDs are activated. At the fourth position 66 all LEDs are activated so that the flashlight is operating at full illumination. However, the fourth position may be designed to allow any desired sequence of LEDs to be activated. Additionally, the thumb wheel may be designed having any number of positions each corresponding to the activation of any desired number of LEDs. It will be appreciated by one skilled in the art that, as the number of activated LED's increases, the life of the battery source 16 decreases. Thus, the switch can also be used to control the life of the battery source.

Figure 3:
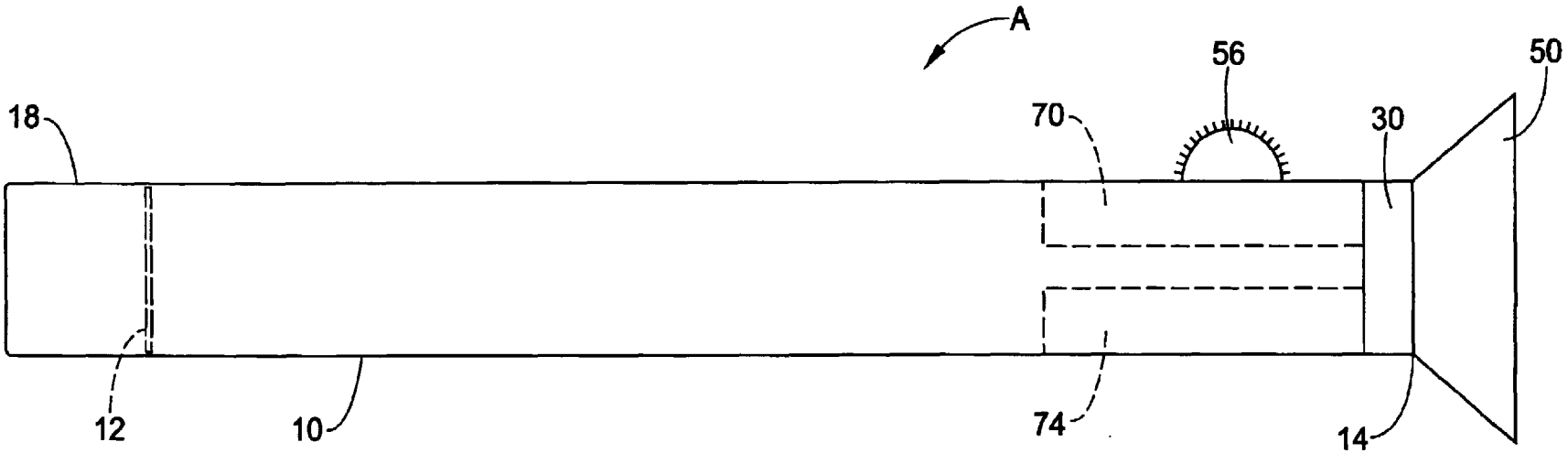
FIG. 3 is an elevational view of another preferred flashlight in accordance with the present invention.

Turning now to FIG. 3, the flashlight optionally includes an electronic current regulator 70 enclosed by the housing. The current regulator has circuitry coupled to the optical output switch 56 which permits the LED beam to remain at a constant or desired light level. As a result, the electronic current regulator and accompanying circuitry provide increased efficiency of battery lifetime. Additionally, a dynamic pulse control system 74 coupled to the switch 56 is optionally enclosed by the housing and operates to take advantage of the persistence of the human eye perceiving the pulsed beam to be continuous. Such a pulse control system works well since the human eye retains the impression of an image for a short time after the image has disappeared. Furthermore, the pulsing can be used to increase the peak current through the LED source, thus increasing the effective light output. The pulse control system can adopt a wide variety of concepts, such as variably pulsing different LEDs in the array over a desired activation sequence, or pulsing one or more of the LEDs to different levels.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

What is claimed is:

1. A flashlight assembly comprising:

a housing;

at least two light emitting diodes (LEDs) mounted within the housing generating a mechanically adjustable LED beam and serving as a light source;

a reflector extending from an end of the housing for focusing and dispersing the at least two LEDs to a desired light contour; and an adjustable switch coupled to a variable resistor for controlling the level of optical output wherein the switch is adapted to selectively turn on and off any select number of the at least two LEDs, thereby allowing a user to choose from several different levels of illumination wherein said reflector is fixed and the LEDs serving as the light source are selectively movable for focusing and dispersing the LED beam as desired.

2. The flashlight assembly according to claim 1, wherein the reflector is selectively adjustable for focusing and dispersing the LED beam as desired.

3. The flashlight assembly according to claim 1, wherein the reflector is fixed and the LED serving as the light source is selectively moveable for focusing and dispersing the LED beam as desired.

4. The flashlight assembly according to claim 1, wherein a plurality of LEDs are arranged concentrically around a single LED thereby forming a substantially circular configuration.

5. The flashlight assembly according to claim 1, wherein the housing encloses a series of batteries operating as the power source for the flashlight.

6. The flashlight assembly according to claim 1, wherein the switch operates as a step level variable control having at least two distinct levels of illumination.

7. The flashlight assembly according to claim 1, wherein the switch operates as a rheostat having continuous variable control thereby allowing selective levels of illumination.

8. The flashlight assembly according to claim 1, further comprising an electronic current regulator enclosed by the housing for allowing the LED beam to remain at a constant and desired light level.

9. The flashlight assembly according to claim 1, further comprising a dynamic pulse control system.

* * * * *